United States Patent [19]

Inukai et al.

[11] Patent Number: 4,928,719

[45] Date of Patent: May 29, 1990

[54] METHOD AND APPARATUS FOR PREVENTING PULSATIONS IN A FLOWING FLUID

[75] Inventors: Yuzo Inukai; Mitsuyuki Nakayama, both of Shizuoka, Japan

[73] Assignee: Fuji Photo Film Co., Ltd., Kanagawa, Japan

[21] Appl. No.: 332,915

[22] Filed: Apr. 4, 1989

[30] Foreign Application Priority Data

Apr. 5, 1988 [JP] Japan ..... 63-082172

[51] Int. Cl.[5] ..... F15D 1/02; F15D 1/20

[52] U.S. Cl. ..... 137/1; 138/30; 251/7; 137/568

[58] Field of Search ..... 138/30; 137/568, 1; 251/7

[56] References Cited

U.S. PATENT DOCUMENTS

| | | | |
|---|---|---|---|
| 3,511,469 | 5/1970 | Bell | 251/7 |
| 3,867,963 | 2/1975 | Ballard | 137/568 X |
| 4,222,414 | 9/1980 | Achener | 138/30 |
| 4,523,977 | 6/1985 | Cantini . | |
| 4,651,781 | 3/1987 | Kandelman | 138/30 |

FOREIGN PATENT DOCUMENTS

| | | |
|---|---|---|
| 56-160497 | 12/1981 | Japan . |
| 58-217890 | 12/1983 | Japan . |
| 59-73692 | 5/1984 | Japan . |

*Primary Examiner*—Alan Cohan

*Attorney, Agent, or Firm*—Sughrue, Mion, Zinn, MacPeak & Seas

[57] ABSTRACT

A fluid-pulsation preventing method and apparatus are disclosed. A fluid is pressure-fed by means of a pump along a path, a flexible pipe is provided in the path, and the volume of the flexible pipe is externally elastically controlled. This external control is such that the sectional area of the flexible pipe is controlled in accordance with pulsation by increasing or decreasing the area depending upon variations in the amount of pulsation, to thereby absorb and prevent the pulsation. This control is achieved using coil springs and rigid plates disposed so that motion of the coil springs deforms the flexible pipe through the rigid plates. The force to be applied to each of the coil springs is set to 5 to 120 Kgf or the spring constant is 0.5 to 3.0 Kgf/mm.

13 Claims, 3 Drawing Sheets

FIG. 1-a
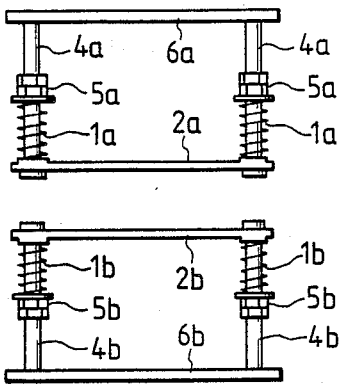
FIG. 1-b
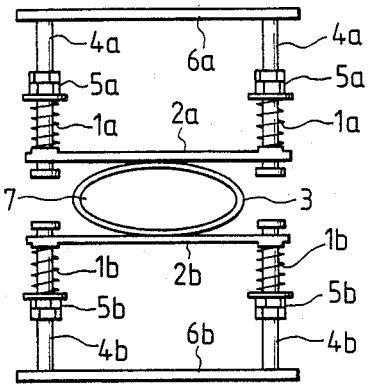
FIG. 1-c
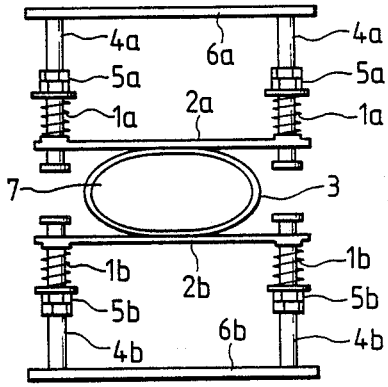
FIG. 2
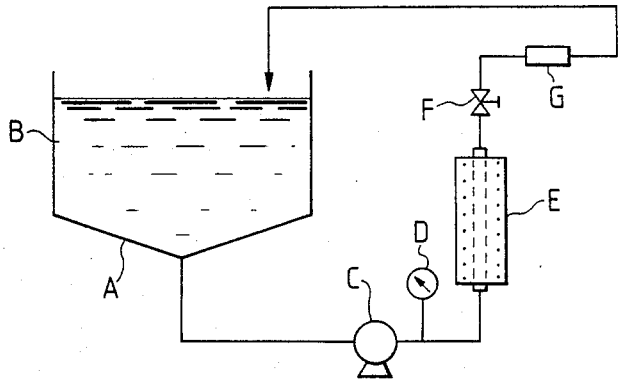

METHOD AND APPARATUS FOR PREVENTING PULSATIONS IN A FLOWING FLUID

BACKGROUND OF THE INVENTION

The present invention relates to a method and an apparatus for preventing pulsation generated in a fluid (particularly a liquid) when the fluid is pressure-fed through piping or the like, and particularly relates to a method for preventing pulsation of fluid generated in the case where liquid is pressure-fed by means of a pump, which is apt to generate pulsation, such as a diaphragm pump, a plunger pump, a gear pump, or the like.

Generally, a pressure-feeding pump, which is apt to generate pulsation, has been Widely used When a gas or a liquid such as paint, photosensitive coating liquid, or the like is pressure-fed from a source to its destination (e.g. an apparatus for painting) through a pipe or the like.

If pulsation of pressure-fed fluid is sufficiently extreme or violent, the feeding of the fluid becomes discontinuous, making volume regulation difficult, if not impossible. In addition, the variations in pressure due to the pulsation can cause an over-load on and damage the feeding pump.

Moreover, where the fluid is a photosensitive coating liquid being pressure-fed to a coating apparatus (for application to a material), if pulsation occurs, uniformly coated products cannot be obtained, and the coating liquid cannot achieve its function as a photosensitive material. In addition, in a painting process, discharge of the paint or the like becomes uneven or discontinuous making it extremely difficult to paint uniformly.

Accordingly, when feeding fluid through piping using a pump, it is necessary to eliminate as much of the pulsation as possible.

Conventionally, in a method of preventing or reducing pulsation, a closed hollow chamber is communicated with a portion of a pipe connecting a pressure-feeding portion of a pressure-feeding pump or the like to a portion of destination so that the pulsation generated in pressure feeding the liquid can be absorbed as compression/expansion of air in the hollow chamber. The hollow chamber is in a closed state except that the inside of the chamber is communicated with the pipe, and the air pressure inside the chamber is increased beyond atmospheric pressure in pressure-feeding the liquid because the air is pressured into the hollow chamber at that time. Relating to this method, various inventions are disclosed, for example, in Japanese Patent Unexamined Publication Nos. 56-160497 and 58-217890 and Japanese Utility Model Unexamined Publication No. 59-73692.

However, it has been found that pulsation preventing methods have various drawbacks.

In the method in which the closed hollow chamber is communicated with the feeding pipe, the degree of pulsation varies remarkably depending on conditions such as the kind of pump, the feed pressure, the feed quantity, the characteristics of the fluid, the material and inner diameter of the pipe, etc. However, it is necessary to determine the size of the hollow chamber in accordance with the degree of the pulsation. That is, it is necessary to make the volume of the chamber larger as the pulsation becomes larger. Accordingly, the size of the hollow chamber is designed on the basis of the foregoing conditions. It is therefore necessary to prepare chambers having various inside volumes. Accordingly, the manufacturing costs and labor are extremely large.

Further, if the degree of pulsation is large, and the liquid is expensive or may change in conditions with time, such as a photosensitive coating liquid, it is necessary to use a hollow chamber having a large volume to prevent pulsation. As a result, a larger amount of liquid flows into the chamber in pressure feeding, which increases the amount of waste, because any excess liquid is exhausted after completion of the pressure feeding.

In order to improve the foregoing defects, Japanese Patent Unexamined Publication No. 56-160497 discloses a method in which a liquid is pressure-fed after the air pressure inside a hollow chamber has been made higher than atmospheric pressure.

Such a method is disadvantageous in that a liquid which has been subjected to treatment for removal of a dissolved gas (e.g. dissolved air by deaeration treatment), if the liquid is pressure-fed in the hollow chamber for a long time, the deaeration-treated liquid absorbs air so that not only the effect of the deaeration treatment is counteracted, but also the amount of the liquid flowing into the holloW chamber increases.

The pulsation preventing method using such a hollow chamber has a further disadvantage that it requires much labor and time to clean the chamber when a new liquid to be pressure-fed is to be used.

In place of the pulsation preventing method using such a hollow chamber having various disadvantages as described above, Japanese Patent Unexamined Publication No. 58-217890 and Japanese Utility Model Unexamined Publication No. 59-73692 disclose pulsation preventing methods using elastic tubes which are able to expand/contract axially.

The foregoing pulsation preventing methods using such elastic tubes are disadvantageous in that when an organic solvent, a photosensitive coating liquid using an organic solvent as a solvent, or an aqueous photosensitive coating liquid including an organic solvent, are used, the elastic tubes swell with or are dissolved in the organic solvent to thereby lose their characteristics, so that it sometimes becomes difficult if not impossible to achieve the pulsation preventing effect.

It has therefore been required to provide elastic tubes which are proven to withstand an organic solvent. At present, however, there are no known inexpensive elastic tubes which are useful for any kind of organic solvents. Further, although there is an elastic tube made of a material which is proven against a certain kind of organic solvent, such an elastic tube is so expensive and therefore very disadvantageous from an economical point of view.

SUMMARY OF THE INVENTION

It is an object of the present invention to provide a fluid-pulsation preventing method, in which the foregoing problems are solved. Specifically, it is an object of the invention to achieve a pulsation compensating or preventing apparatus which is inexpensive, essentially eliminates any loss of liquid, is easy to operate and clean (de-gas), and is practical for using organic solvents, while achieving superior pulsation prevention.

The above objects are achieved by a fluid-pulsation preventing method in which when a fluid is pressure-fed by means of a pump along a path, a flexible pipe is provided in the path, and the volume of the flexible pipe is externally elastically controlled. This external control is such that the sectional area of the flexible pipe is controlled in accordance with pulsation by changing the area depending upon the amount of pulsation, to thereby absorb and prevent the pulsation. This control is achieved using coil springs and rigid plates disposed so that motion of the coil springs deforms the flexible pipe through the rigid plates.

The above objects can be achieved effectively by the above-mentioned fluid-pulsation preventing method and apparatus in which the pressure for pressure-feeding the fluid in the flexible pipe is selected to the 0.5 to 2.0 $Kg/cm^2$ gauge pressure. The above objects can further be achieved effectively by the above-mentioned fluid-pulsation preventing method in which the force to be applied to each of the coil springs is set to 5 to 120 Kgf or the spring constant is 0.5 to 3.0 Kgf/mm.

BRIEF DESCRIPTION OF THE DRAWINGS

FIG. 1 is a sectional view showing the concept in which coil springs and rigid plates act on a flexible pipe in an embodiment of the fluid-pulsation preventing method according to the present invention;

FIG. 2 is a schematic view of an apparatus used to conduct experiments for confirming the effect of the pulsation preventing method according to the present invention;

DETAILED DESCRIPTION OF THE PREFERRED EMBODIMENTS

Figure 3:
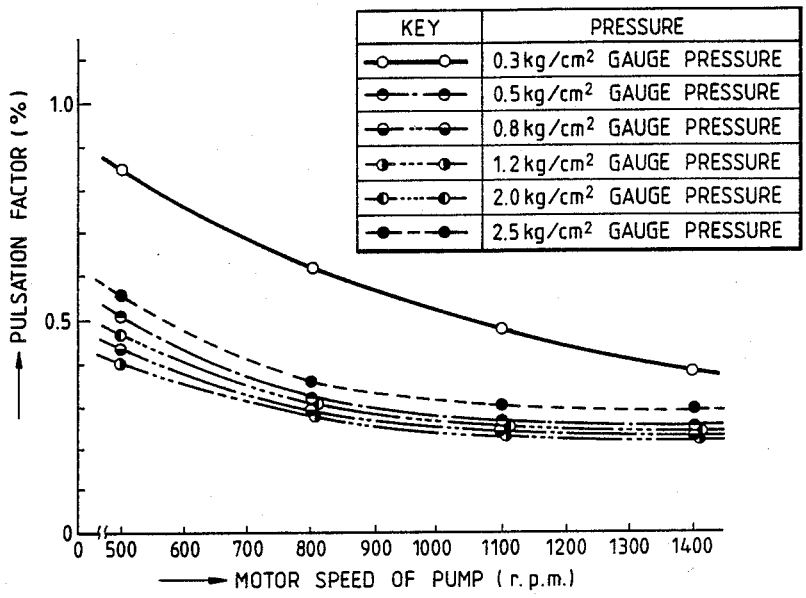
FIGS. 3 and 4 are graphs of the pulsation factor versus the motor speed of a pump, which graphs show the experimental results in Examples 1 and 2 of the invention, respectively.

The present invention will now be described more in detail with reference to the drawings. In the fluid-pulsation preventing method according to the invention, when a fluid is pressure-fed along a path by means of a pump that experiences pulsation, a flexible pipe is provided in the path and its cross sectional area is externally elastically controlled by an amount in accordance with the extent of the pulsation to thereby absorb and eliminate the effects of the pulsation. The pipe is initially maintained in a state where its cross sectional area is less than its maximum area, so as to leave sufficient room for expansion to absorb varying pulsations. During a pulsation, the area of the pipe increases based on the severity of the pulsation. The pipe is biased or otherwise controlled to return to its initial cross sectional area when the pulsation ceases.

A type of flexible pipe suitable for the present invention is made of an elastic material which does not contract particularly in the circumferential direction or the longitudinal direction, but only has flexibility in the radial direction. For example, a pipe able to elastically contract can be used. This type of flexible pipe is inexpensive, yet may be used with an organic solvent, a photosensitive coating liquid using an organic solvent, an aqueous photosensitive coating liquid including an organic solvent, or the like. Accordingly, for example, the pipe can be formed of a relatively inexpensive material such as teflon or the like using, for example, polyethylene or polyethylene hexafluoride stable for almost all organic solvents. Generally, a hose made of polyethylene hexafluoride or the like has very low capability of absorbing pulsation by its circumferential and longitudinal expansion/contraction because expansion/contraction thereof is extremely small in comparison with an elastic tube although the expansion/contraction of the polyethelene hexafluoride (or the like) hose depends on its thickness. Thus, such a pipe is emanantly practical for use in the present invention. However, in a mechanism for preventing pulsation by means of an elastic tube arranged to absorb a change in amount of discharge periodically generated by a pump or the like, the change in the inside volume of the elastic tube due to expansion/contraction (particularly in the circumferential direction) of the elastic tube is used to reduce pulsation. In essence, the mechanism functions by means of a periodic change in volume of the elastic tube.

The inventive pulsation preventing method in the case of pressure-feeding a liquid may be any method so long as the method uses a function in which the hose's volume changes in accordance with the pressure of the liquid pressure-feeding even when a hose or the like is used. This volume change can be achieved by a change in cross sectional shape, rather than an expansion/contraction of the tube wall. Thus, it is not always necessary to use expansion/contraction like the case of the elastic tube.

As noted above, the flexible pipe to be used in the pulsation preventing method according to the present invention may be any kind of flexible tube so long as its sectional area can be changed without changing at least the circumferential length of the cross section. In addition, the shape of the pipe partitioned by the inner wall of the pipe when the inside volume becomes a maximum is not particularly limited but may be cylindrical, oval, spherical, or any other shape including a combination of shapes. A circular or oval cross section when the pipe is at its state of maximum cross sectional area is preferable.

The inner and outer diameters of the flexible pipe are not limited but may be the same as, larger, or smaller than that of other pipes. In addition, the inner diameter of the flexible pipe at a portion Where the pipe is connected to the feeding path pipe is not particularly limited but may be the same as or smaller than that of the feeding path pipe. Such a flexible pipe may be connected to the feeding path pipe through one opening so that the opening is used as an inlet/outlet for a liquid, or may be connected to another feeding path pipe with two or more openings so as to separate the inlet from the outlet of the fluid.

The inside sectional area of the flexible pipe may be limited to a predetermined value smaller than the maximum sectional area by means of a member directly acting as an elastic body or may be elastically limited to a predetermined value smaller than the maximum sectional area by means of a rigid body indirectly from the outside of the pipe.

According to the present invention the member which functions as the elastic body for elastically limiting the sectional area of the flexible pipe may be any of the following, e.g.: a spring such as a coil spring, a spiral spring, a plate spring, a volute spring, or the like, a known elastic body such as natural rubber, various kinds of synthetic rubber, synthetic resin, or the like, a member in which a fluid such as a gas, a liquid, or the like is enclosed by means of a film, a vessel, or the like having flexibility or being contractible, a member in which the shape of the above fluid is restricted by the above means, or the like, a combination of any of the above members and a rigid body, or the like. However, the preferred method is one in which the flexible pipe is deformed by a rigid plate in accordance with the movement of a coil spring caused by pulsations transmitted via the rigid plate to the spring in order to limit the sectional area of the flexible pipe, in view of a manufacturing cost, a size, drive conditions, endurance for a long time, maintenance, and so on, of the pulsation preventing apparatus. In this case, the rigid plate may be deformed in the range in which the rigid plate is not subject to plastic deformation.

According to the present invention, the concept that "the sectional area of a pipe is elastically limited to a value smaller than the maximum sectional area from the outside of the pipe" means that "the shape of a hose or the like having a circular or substantially circular cross section in the radial direction is initially made to be oval or substantially oval to make the sectional area smaller than its maximum sectional area so that the shape of its cross section when it is increased by absorption of pulsation becomes circular or substantially circular, this operation being repeated."

By using such a change, it becomes possible to change the volume of a hose or the like without changing its axial length and its circumferential length to thereby make the hose prevent pulsation.

According to the principle of the pulsation preventing method of the present invention, any hose or the like may be used so long as the hose or the like has flexibility at least at one cross sectional spot along its length, and therefore the shape of the hose is not limited to that described above.

It should be understood that the flexible pipe or the like includes a composite hose in which a chemical-resistant material (for example, polyethylene hexafluoride or the like having a thickness of 0.5 to 2.5 mm) is used to form only a hose portion which comes in contact With an organic solvent while rubber or the like is used to form other portions of the hose to improve the pressure-withstanding property of the flexible pipe or the like, to lower the cost of the pipe, and to give elasticity to the pipe or the like so as to follow the frequency of pulsation. Further, the flexible pipe includes a pipe which is made of an expandable/contractible material such as rubber and which is limited by a material such as thread or wire, having no expansion/contraction property so that the material does not circumferentially expand/contract.

The changes in the cross section of the flexible pipe need occur only at a portion of the pipe; however, the changes may occur all over the pipe.

The change of the sectional area of the above-mentioned pipe should be caused by changing the sectional area in accordance with the pulsation without changing the circumferential length of the cross section of the pipe.

"To change the sectional area of the flexible pipe in accordance with the pulsation in pressure-feeding operation without changing the circumferential length of the cross section of the pipe" means that "a correlation is provided between the pressure exerted, for example, by the pressure-fed fluid onto the inner wall of the pipe and the sectional area of the pipe, and the sectional area is increased/decreased by changing the shape of the cross section while the circumferential length of the cross section is maintained to be constant without making the material constituting the pipe expand or contract." Changing the sectional area can be accomplished in a variety of ways, for example, a member having flexibility is used at least at one cross section of a pipe (one position along the length of the pipe) so that the sectional area of the pipe may be elastically controlled from the outside of the pipe at least at that one position.

Referring to the drawings, the pulsation preventing method according to the present invention will be specifically described. FIGS. 1-*a*, 1-*b*, and 1-*c* show the outline of an embodiment of the pulsation preventing method in which the shape of the cross section of the flexible pipe such as a hose, is repeatedly changed essentially between an oval and a circle. It should be noted that the mutual relation between the coil springs and the rigid plates, the shapes of these elements, and so on, are not limited to the illustrated shape and method.

Rigid plates 2*a* and 2*b* are separated from each other so as to be opposite to each other in order that the radial sectional area of a flexible pipe 3 is previously decreased from its maximum sectional area and after the pipe has absorbed pulsation of a liquid by the increase of its sectional area, the increased sectional area returns to its original value.

The rigid plates 2*a* and 2*b* are supported respectively by two pairs of coil springs l*a*, 1*b* through which corresponding pairs of left and right screw shafts 4*a*, 4*b* are inserted. The positions of the pairs of springs 1*a*, 1*b* are restricted by pairs of nuts 5*a*, 5*b*, respectively. The pairs of shafts 4*a*, 4*b* are fixed to frames 6*a*, 6*b*, respectively. The distance between the rigid plates 2*a*, 2*b* is adjusted by the pairs of nuts 5*a*, 5*b*. As shown in FIG. 1-*b*, after the plates, springs, nuts etc, are assembled, the flexible pipe 3 is positioned between the plates 2*a*, 2*b*.

A liquid 7 pressure-fed by a pump such as a diaphragm pump, a plunger pump, a gear pump, or the like, which generates pulsation is pressure-fed through the pipe 3. When back pressure is applied by a valve or the like (not shown) after the liquid 7 has passed through the flexible pipe 3, the pressure rise due to pulsation is absorbed by the increase in volume of the pipe 3 as shown in FIG. 1-*c*.

Just after the pipe 3 has absorbed the pressure rise due to this pulsation force is applied to the pipe 3 by the coil springs 1*a*, 1*b* so as to decrease the volume to return the pipe 3 to its original state (which existed prior to the volume increase) shown in FIG. 1-*b*.

As described above in the liquid-pulsation preventing method according to the present invention, the pressure rise due to a pulsation is absorbed by the increase in volume of the pipe, which is flexible at least in its cross sectional shape. Therefore, factors affecting the pulsation preventing effect include the pressure exerted on the liquid flowing in the foregoing flexible pipe, the characteristics and material of the coil springs 1*a*, 1*b* acting as elastic bodies, the type and discharge amount of the pump, the distance between the rigid plates, and so on. These factors are suitably selected in accordance with the flow characteristic of the liquid to be used, the material and shape of the pipe, and the pulsation.

For example, in the case where the elasticity of the coil springs acting as elastic bodies is large, the pulsation preventing effect is little when the pressure acting on the liquid flowing in the flexible pipe is low because the increase in volume of the flexible pipe or the like is extremely little. In addition, when the pressure is too high, the pulsation preventing effect becomes little By contrast, where the elasticity of the coil springs acting as elastic bodies is used to prevent the effect of pulsation, the pulsation preventing effect becomes little when the pressure exerted on the liquid flowing in the flexible pipe is high.

Further, in the case where the distance between the pair of rigid plates is large, the pulsation preventing effect is little because the amount of increase in the volume of the flexible pipe is little. This means that if the spring characteristics of the coil springs acting as elastic bodies are set the pressure and the distance between the rigid plates can be adjusted to effectively prevent the pulsation.

It may be considered that when pressure is exerted on the flexible pipe or the like, the force received by the rigid plates is equal to the product of the area where the pipe or the like is in contact with the rigid plates and the exerted pressure, and the force is equally distributed to all the coil springs. (The weight of the rigid plates per se is also distributed to the coil springs.) Accordingly, as described above, there is a close relation among the pressure exerted to the flexible pipe, the force acting on the coil springs the characteristics or spring constant of the coil spring and the distance between the rigid plates. To effectively prevent pulsation, for example, where a photosensitive coating liquid is pressure-fed, it is desirable that the pressure exerted on the flexible pipe is selected to be 0.3 to 2.5 kg/cm$^2$ gauge pressure, preferably 0.5 to 2.0 kg/cm$^2$ gauge pressure, the force acting on each coil spring is selected to be 3 to 150 kgf, preferably 5 to 120 kgf and the spring constant of the coil spring is selected to be 0.3 to 4.0 kgf/mm, preferably 0.5 to 3.0 kgf/mm.

In the case of using the flexible pipe having an inner diameter of 35 to 40 mm and a thickness of 4 to 8 mm, it is desirable that the distance between the rigid plates in the state where no liquid is being pressure-fed is selected to be 15 to 40 mm, preferably 15 to 30 mm. However, since the shape of the flexible pipe is determined in accordance with the amount of liquid being pressure-fed, the required degree of the pulsation prevention, etc., it is desirable to determine the distance between the rigid plates in an optimum way after the pipe has been selected.

FIG. 2 shows the flow of an experimental apparatus for confirming the above effect. In the drawing: the symbol A designates a liquid stock tank; B designates a liquid; C designates a pressure-feeding pump; D designates a pressure gauge; E designates a pulsation preventing apparatus constituted by the flexible pipe 3, the coil springs 1*a* and 1*b*, the rigid plates 2*a* and 2*b*, and the other members of FIGS. 1-*a*, 1-*b*, and 1-*c* (including any members not shown in the drawing); F designates a valve for exerting back pressure to the flexible pipe 3 in the pulsation preventing apparatus E; and G designates a flow meter for measuring pulsation.

The liquid B is sucked from the liquid stock tank A and fed to the apparatus E by the pump C. The valve F is provided downstream of the apparatus E to apply pressure to the liquid in the pipe 3. By adjusting the valve F. the pressure to be exerted on the liquid is properly set by using the pressure gauge D. The flow meter G is provided next to the valve F to measure the pulsation of the liquid which has passed through the valve F, the liquid then being returned to the tank A.

With such a configuration, the capability of pulsation prevention of the present invention is achieved.

Specific examples of the present invention will be described hereunder. However, the examples do not at all limit the scope of the present invention.

EXAMPLE 1

The experimental apparatus as shown in FIG. 2 was used to measure the pulsation in the photosensitive coating liquid having the composition and the physical characteristics shown in Table 1.

| | |
|---|---|
| 1. Pulsation Prevention Apparatus | |
| (1) Flexible Pipe | |
| (a) Inner Diameter | 35 mm |
| (b) Length | 700 mm |
| (c) Material | Composite Hose |
| Inside | Polyethylene hexafluoride Thickness 1.5 mm |
| Outside | EPT rubber (rubber hardness 70) Thickness 5 mm |
| (2) Coil Spring | |
| (a) Spring Constant | 3.0 Kgf/mm |
| (b) Material | SUS-304 |
| (c) Number | 8 |
| (3) Rigid Plate | |
| (a) Material | SUS-304 |
| (b) Length | 600 mm |
| (c) Initial distance between the rigid plates 24 mm (without pressure-feeding) | |
| 2. Pressure Feeding Pump | |
| (1) Type | No-pulsation type (tandem) plunger pump |
| (2) Motor Speed | Maximum 1420 r.p.m. |
| (3) Discharge Amount | Maximum 4.3 l/min |

TABLE 1

| Photosensitive Coating Liquid | | |
|---|---|---|
| Composition | Ester compound of chloride naphthoquinone-(1.2)diazide-(2)-5-sulfonate and poly-P-hydroxyethylene | 0.7 weight portions |
| | Novolac-type phenol resin | 2.0 weight portions |
| | Methyl ethyl keton | 15.0 weight portions |
| | Methylcellosolve acetate | 25.0 weight portions |
| | Fluorine-series surfactant | 0.2 weight portions |
| Physical Property | Viscosity | 1.8 cp (measured at 20° C.) |
| | Specific gravity | 0.902 (measured at 20° C.) |
| | Surface tension | 24 dyne/cm (measured at 20° C.) |

Under the above conditions, the state of pulsation was measured by means of the flow meter G while the discharge amount of the coating liquid and the pressure applied to the pulsation preventing apparatus were changed by changing the motor speed of the pressure feeding pump and the opening of the valve F. FIG. 3 shows the results.

To express the degree of pulsation, the term "pulsation factor" is defined as follows: the ratio of a fluctuation value of discharge amount ($\delta Q$) to an average value of discharge amount (Q) in discharge operation in the case where the motor speed of a pressure-feeding pump is set to a certain value, the ratio being expressed in percentage, as follows:

$$\text{Pulsation factor} = \frac{\delta Q}{Q} \times 100\ (\%)$$

EXAMPLE 2

Figure 4:
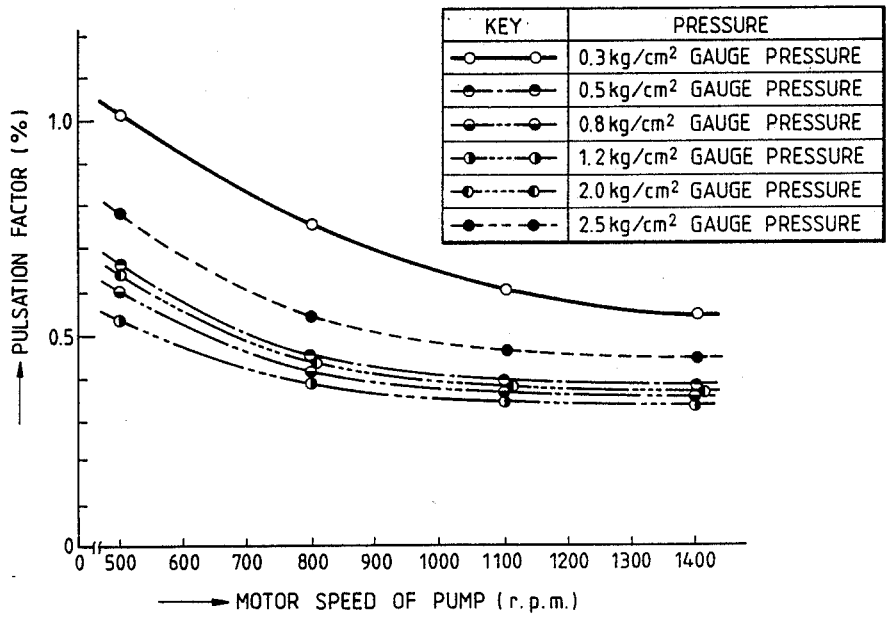

Pulsation was measured under the same conditions as those in Example 1 except that the length of the pipe was 320 mm, the spring constant of the coil springs was 0.5 Kgf/mm, the number of coil springs was sixteen, and the length of each of the rigid plates was 200 mm in the pulsation preventing apparatus of Example 1. The result is shown in FIG. 4.

COMPARATIVE EXAMPLE 1

Figure 5:
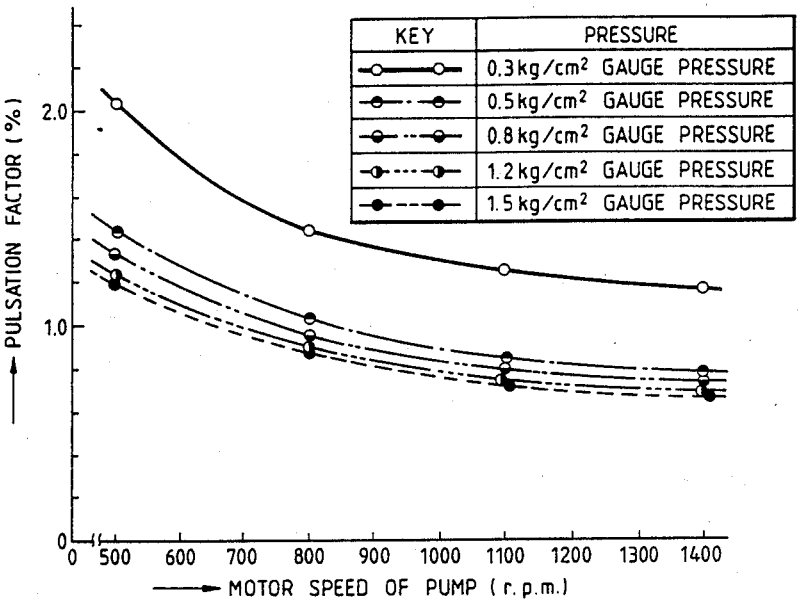
FIGS. 5 and 6 are graphs of the pulsation factor versus the motor speed of a pump, Which graphs show the experimental results in Comparative Examples 1 and 2 of previously proposed methods.

Pulsation was measured under the same conditions as those in Example 1 except that the coil springs and the rigid plates of the apparatus of Example 1 were removed. The result is shown in FIG. 5.

COMPARATIVE EXAMPLE 2

Pulsation was measured under the same conditions as those in Example 1 except that a pipe of stainless steel was used instead of the apparatus used in Example 1. The result is shown in FIG. 6.

As seen from the results of Comparative Examples 1 and 2, the pulsation preventing effect due to only the composite hose is extremely little. This is because, probably, the thickness of the polyethylene hexafluoride used inside of the composite hose is 1.5 mm so that the composite hose has no expanding/contracting property in the radial direction, resulting in extremely little pulsation preventing effect.

Figure 6:
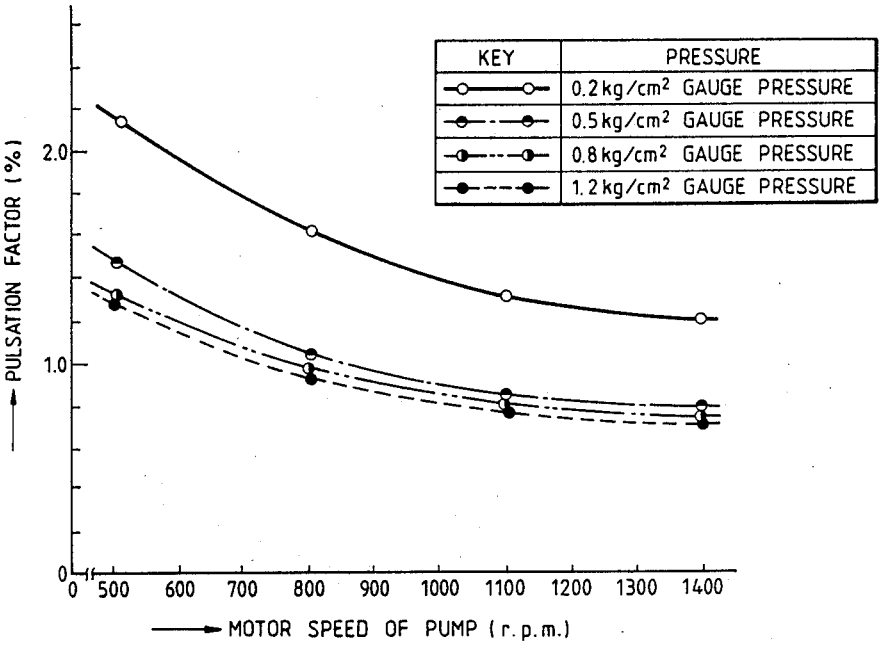

In contrast, when a comparison is made as to the results of the Examples of the invention shown in FIGS. 3 and 4 with the results of the Comparative Examples shown in FIGS. 5 and 6, it is found that the fluid-pulsation preventing method according to the present invention exhibits an extremely remarkable effect. It is further found that in the case, of using the coil springs and the flexible pipe in the Example 1, the pressure applied to a liquid is optimum when it is selected to be within a range of 0.5 to 2.0 $Kg/cm^2$ gauge pressure. Further, the drawings show that if the pressure applied on the liquid in the composite hose is too high, the pulsation preventing effect is reduced a little. In the case of Example 2, it is found that the optimum value of the pressure within the same range of 0.5 to 2.0 $Kg/cm^2$ gauge pressure while the spring constant of the coil spring is 0.5 Kgf/mm. Further, where the length of the flexible pipe is shortened to 320 mm as in Example 2, it is found that, compared with Example 1, a sufficient effect can be obtained if the amount of liquid to be pressure-fed and the pulsation factor at that time satisfy the required conditions, even though the pulsation factor becomes generally high. The respective values of the force applied onto each coil spring when the pulsation is effectively prevented were 120 kgf which was the maximum one in Example 1 and 5 kgf which was the minimum one in Example 2.

Thus, the method according to the present invention exhibits a remarkable effect on a fluid, particularly a liquid. It goes without saying that the method exhibits an effect also on a liquid including a solid body or a gas, and a gas per se.

As described above, it is possible largely to prevent or reduce pulsation generated by a pressure-feeding pump in spite of the simple configuration of the invention by using a fluid-pulsation preventing method according to the invention in which: when a fluid is pressure-fed by means of a pump having pulsation, a flexible pipe is provided in a path of the fluid and the flexible pipe is arranged so as to be elastically controlled from its exterior so that its sectional area is initially set smaller than its maximum sectional area, and its sectional area is controlled in accordance with pulsation occurring during pressure feeding of the fluid. This method thereby absorbs and prevents the pulsation. A device according to the invention is characterized in that coil springs are provided so as to receive and respond to the pulsation through rigid plates so that motion of the coil springs deforms the flexible pipe through the rigid plates, by the above-mentioned fluid-pulsation preventing method in which the pressure for pressure-feeding the fluid in the flexible pipe is selected to be about 0.5 to 2.0 $Kg/cm^2$ gauge pressure. In addition, the spring constant of the coil springs is set to 0.5 to 3.0 Kgf/mm, and the force to be applied to each of the coil springs is set to 5 to 120 Kgf. Accordingly, a fluid can be transported and fed at a fixed rate to achieve a fixed amount. In addition, troubles can be prevented from occurring in the pressure-feeding pump, and pulsation can be prevented from occurring particularly in an organic solvent when the solvent is pressure-fed. Further, in the case where a coating is applied with a photosensitive coating liquid which uses an organic solvent as a solvent for the liquid or which contains therein an organic solvent by means of a coating apparatus, a uniform photosensitive coating can be obtained, and in the case where painting is performed with a paint of organic solvent series, a uniformly painted surface can be obtained.

Further, in comparison with the case of using a hollow chamber, the arrangement of the apparatus is simple, the longitudinal size of the apparatus can be made short if the spring constant and the number of the coil springs are suitably selected, and further the rigid plates can be made to have a width which is a little wider than the width of the deformed flexible pipe so that the transverse size of the apparatus can be made small. As a result, not only the whole apparatus becomes small in size and light in weight but also the apparatus is extremely economical in its cost, labor, liquid loss, and cleaning property. Further, the apparatus is extremely economical in its manufacturing cost and general-purpose utility for a liquid to which the invention is applied even in comparison with the case of using an elastic tube capable of circumferentially expanding/contracting.

We claim:

1. A method of mechanically compensating for and thus preventing pulsations in a flowing fluid experiencing pulsations during pressure-feeding of a fluid along a path by means of a pump, said method comprising the steps of:

connecting a flexible hose in said path and passing said fluid through said flexible hose;

elastically controlling and allowing the cross-sectional area of said flexible hose to fluctuate within a range defined between a maximum cross section and a predetermined smaller cross section in accordance with pulsating experienced in pressure feeding of said fluid to thus absorb and prevent the pulsation, wherein said hose is biased by flattening into said predetermined smaller cross-sectional area smaller than said maximum sectional area using coil springs connected to rigid plates in contact with said hose so that force of said coil springs deforms said flexible hose through said rigid plates.

2. A method according to claim 1, wherein said elastically controlling step is conducted by deforming a cross-sectional shape of said flexible pipe, and wherein a circumference of said flexible pipe is maintained at a substantially constant circumferential measurement regardless of said deforming and regardless of said pulsations.

3. A method according to claim 1, wherein the pressure for pressure-feeding said fluid in said flexible hose is 0.5 to 2.0 $Kg/cm^2$ gauge pressure.

4. A method according to claim 1, wherein a spring constant of said coil springs is 0.5 to 3.0 Kgf/mm.

5. A method according to claim 3, wherein a spring constant of said coil springs is 0.5 to 3.0 Kgf/mm.

6. A method according to claim 1, wherein a biasing force applied to each of said coil springs is 5 to 120 Kgf.

7. A method according to claim 3, wherein a biasing force applied to each of said coil springs is 5 to 120 Kgf.

8. A method according to claim 4, wherein a biasing force applied to each of said coil springs is 5 to 120 Kgf.

9. An apparatus for mechanically compensating for and thus preventing pulsations in a fluid experiencing pulsations during pressure-feeding of a fluid along a path by means of a pump, said apparatus comprising:

a flexible hose disposed in said path; and biasing means disposed outside said hose and in contact therewith for biasing said hose into a smaller cross-sectional shape which has a cross-sectional area less than a maximum cross-sectional area of said hose, said biasing means allowing said cross-sectional area of said hose to fluctuate within a range defined between said maximum cross-sectional area and smaller cross-sectional area by allowing said hose to increase in cross section toward said maximum in response to pulsation, wherein said biasing means comprises a pair of rigid plates disposed in contact with the exterior of said hose and facing each other, and a plurality of coil springs for biasing said plates against said hose.

10. An apparatus according to claim 9, wherein said biasing means performs said biasing to deform a cross-sectional shape of said hose, and wherein said flexible hose is formed so as to have a substantially constant circumferential distance regardless of pulsation and regardless of said deformation.

11. An apparatus according to claim 9, wherein said hose is formed of polyethylene hexafluoride.

12. An apparatus according to claim 9, wherein the pressure for pressure-feeding said fluid in said hose is 0.5 to 2.0 $Kg/cm^2$ gauge pressure.

13. An apparatus according to claim 12, wherein a spring constant of said coil springs is 0.5 to 3.0 Kgf/mm.

* * * * *